United States Patent [19]

Botnick

[11] Patent Number: 4,762,143

[45] Date of Patent: Aug. 9, 1988

[54] FAUCET MANIFOLD

[76] Inventor: Irlin H. Botnick, 3155 Kersdale, Pepper Pike, Ohio 44124

[21] Appl. No.: 57,118

[22] Filed: Jun. 3, 1987

Related U.S. Application Data

[63] Continuation-in-part of Ser. No. 735,664, May 20, 1985, Pat. No. 4,671,316.

[51] Int. Cl.[4] ..... E03C 1/04

[52] U.S. Cl. ..... 137/315; 137/359; 137/801; 4/192; 29/157.1 R

[58] Field of Search ..... 251/215, 218, 304; 29/157.1 R; 4/191, 192, DIG. 7; 137/359, 801, 315

[56] References Cited

U.S. PATENT DOCUMENTS

| | | | |
|---|---|---|---|
| D. 182,867 | 5/1958 | Young | D91/03 |
| D. 235,546 | 6/1975 | Landell | D23/01 |
| 866,642 | 9/1907 | Gillin | 4/192 |
| 1,754,217 | 3/1927 | August, Jr. | 137/359 |
| 2,591,991 | 10/1947 | Young | 137/111 |
| 3,010,474 | 6/1958 | Moen | 137/359 |
| 3,035,276 | 5/1962 | Hanson | 4/191 |
| 3,144,879 | 8/1964 | Baumann | 251/205 |
| 3,229,710 | 1/1966 | Keller, III | 137/359 |
| 3,701,364 | 10/1972 | Hare | 4/192 |
| 3,911,946 | 10/1975 | Humpert et al. | 137/359 |
| 4,290,445 | 9/1981 | Turner | 137/359 |
| 4,356,574 | 11/1982 | Johnson | 137/360 |
| 4,446,885 | 5/1984 | Nolden | 137/360 |
| 4,513,769 | 4/1985 | Purcell | 137/801 |

FOREIGN PATENT DOCUMENTS

| | | | |
|---|---|---|---|
| 1505648 | 3/1978 | United Kingdom | 137/801 |

*Primary Examiner*—A. Michael Chambers
*Attorney, Agent, or Firm*—Wayne D. Porter, Jr.

[57] ABSTRACT

A faucet manifold according to the invention is adapted to be mounted on a countertop over openings through which access can be had to water-conveying conduits. The manifold includes a cover in the form of a plate overlying the openings. The plate is spaced from the surface of the countertop by a skirt extending downwardly from the periphery of the plate. Valve members, water-conveying conduits, and a spout assembly are connected to, and carried by, the plate. All of the components of the manifold can be manufactured inexpensively, many of them in stamping operations. The invention eliminates the need to form parts in casting operations, thereby significantly reducing manufacturing costs.

16 Claims, 2 Drawing Sheets

FAUCET MANIFOLD

BACKGROUND OF THE INVENTION

1. Cross-Reference to Related Patent

The present application is a continuation-in-part of application Ser. No. 735,664, filed May 20, 1985, by Irlin H. Botnick, now U.S. Pat. No. 4,671,316 issued 06/09/87.

2. Field of the Invention

The invention relates to plumbing fixtures and, more particularly, to a faucet manifold and to a method of manufacturing a faucet manifold.

3. Description of the Prior Art

A typical faucet manifold includes as a major component a hollow body portion formed by a casting process employing one or more cores. Inlets for connection to a source of water are provided for the body portion. The usual technique for connecting the inlets to water pipes is by machining threads on either an exterior or interior portion of the inlets. The body portion also is provided with a spout-supporting outlet which, like the inlets, usually is threaded. In order to provide a valving function for each of the inlets, additional openings are formed in the body portion adjacent the inlets. These openings customarily are machined and threaded. Valve members can be positioned in the openings and held in place by means of hold-down nuts.

Faucet manifolds manufactured according to the foregoing description are in widespread use. Such manifolds are substantial pieces of equipment, often weighing several pounds or more. They usually last for many years. Unfortunately, they have a number of drawbacks, probably the most significant of which is the time and expense needed to manufacture the manifolds. The casting process by which the manifolds are manufactured is not susceptible of low-cost, high-volume production. Individual molds and cores must be prepared for individual castings, great amounts of energy are required to melt the metal to be cast, a considerable period of time is required for the castings to cool, the cooled castings must be removed from the molds and cleaned, and the castings then must be machined to final specifications.

Certain manifold constructions are known in which the need for a cast body portion is eliminated. For instance, the patent to Moen, U.S. Pat. No. 3,010,474, issued Nov. 28, 1961, discloses a faucet wherein a deck plate is positioned atop a countertop, exteriorly threaded nipples extend through the deck plate, and a valve body is disposed centrally of the deck plate. The valve body is connected to the nipples by means of inlet pipes. A decorative shell is disposed about the faucet components to provide a pleasing aesthetic effect. The entire assembly is held fast against the countertop by nuts threaded about the nipples or by studs threaded into openings from beneath the deck plate.

Although Moen's device does not employ a large cast body portion, it replaces the cast body portion with a centrally disposed valve body performing all valving and spout functions. Moen's device would not be suitable for use with so-called two-handle valve constructions without considerable modification. Further, even though a cast body portion has not been employed, the Moen device still requires a relatively large number of components.

The patent to Johnson, U.S. Pat. No. 4,356,574, issued Nov. 2, 1982, discloses a faucet assembly somewhat like that of Moen's in that a base plate is secured to the upper surface of a sink deck and a faucet body is connected to the base plate. Although Johnson's faucet assembly can be manufactured relatively inexpensively, it still contains a large number of parts and suffers the further drawback that valve functions are performed by pinch valves which engage flexible, water-conveying conduits. The use of pinch valves in conjunction with flexible conduits is undesirable due to concerns about the reliability of such components.

Despite the existence of different approaches to manifold configurations and construction techniques provided by the prior art, there still is no inexpensive, reliable faucet manifold that avoids the need for castings while utilizing the fewest number of parts. Desirably, a faucet manifold would attain the foregoing objectives, particularly for two-handle valve arrangements.

SUMMARY OF THE INVENTION

The present invention overcomes the foregoing difficulties of the prior art and provides a new and improved faucet manifold and method for manufacturing a faucet manifold. A feature of the invention is that the need for a separate decorative shell as in other faucet manifold constructions is eliminated. A faucet manifold according to the invention is adapted to be mounted on a countertop over openings through which access can be had to water-conveying conduits. The manifold includes a cover defined by a plate and a skirt extending downwardly from the periphery of the plate. The plate is adapted to overlie the openings. The skirt is adapted to engage the countertop so that the plate is spaced from the surface of the countertop, thereby creating a chamber.

In one embodiment suitable for use in a two-handle valve configuration, the plate includes three openings spaced from each other. Vertically oriented sleeves are fitted into the openings. Valve members are disposed in two of the sleeves, and a spout assembly is connected to the third sleeve. The valve-containing sleeves include means for establishing fluid communication between the water-conveying conduits and the sleeves. Separate means are provided for establishing fluid communication between the spout-carrying sleeve and the valve-containing sleeves.

The water-conveying conduits are connected to the valve-containing sleeves by means of tubes brazed to openings formed in the sleeves. Similarly, the valve-containing sleeves are connected to the spout-carrying sleeve by means of tubes which are brazed to openings formed in the sleeves. The tubes connecting the sleeves are disposed within the chamber, while the tubes conveying water to the valve-containing sleeves pass upwardly through the chamber, through openings formed in the plate, and into openings formed in the sides of the valve-containing sleeves at a location above the plate.

The upper ends of the sleeves are configured to retain the valve members and spout assembly by means of hold-down nuts. The entire manifold assembly is held in place against the countertop by means of toggle bolts accessible from above the countertop. Decorative cover knobs are provided for the valve members. The lower ends of the knobs completely surround and cover the sleeves, inlet tubes, and toggle bolts.

A faucet manifold according to the invention can be manufactured exceedingly rapidly and inexpensively. The cover and the sleeves can be formed in stamping operations. The tubing is inexpensive and can be attached to the sleeves quickly and inexpensively by braze rings. Similarly, the sleeves can be connected to the cover by means of braze rings. The sleeve-stamping operation is sufficiently dimensionally accurate that a watertight seal can be established between the interior of the sleeves and the exterior of the valve members. The resultant faucet manifold assembly is quite strong and reliable, and yet its manufacturing cost is less than half that of faucet manifolds employing cast body portions.

Alternative embodiments of the invention are provided in which different methods of manufacture and different materials are employed. Although casting operations generally are to be avoided for the reasons expressed earlier, portions of the faucet manifold can be formed in a casting operation, if desired. The same elements as described in the previously described embodiment are employed, but the cover and the sleeves are formed as a unit in a die casting operation, thus avoiding the use of cores. Water-conveying conduits can be connected to the sleeves by brazing. In another embodiment, the cover and the sleeves can be formed as a unit in a plastic injection-molding operation, and the water-conveying conduits can be connected to the sleeves by the use of cement or solvent.

An especially effective, and indeed preferred, embodiment of the invention is provided in which the plate includes openings having vertically extending flanges. The flanges extend toward the countertop in use. The vertically oriented sleeves are eliminated, and suitably configured valve members are fitted into the openings. Inlet tubes are connected directly to the flanges, and a watertight seal between the valve members and the openings is established by sealing members such as O-rings. Similarly, a spout adapter is secured to the plate and cooperates with an outlet opening in the plate such that valved fluid can be discharged from the faucet manifold.

A feature of the preferred embodiment of the invention is that a channel member cooperates with the plate to create a flow passage connecting valved inlet openings and the outlet opening. An especially effective technique for creating the flow passageway is to provide a laterally extending raised area in the center region of the plate, and to provide a channel member in the form of a trough-like structure having a peripheral skirt. Upon fitting the skirt into the raised area and brazing the channel member in place, a fluidtight flow passage can be created exceedingly inexpensively and rapidly.

The foregoing features and advantages, together with a more complete description of the invention, may be had by referring to the following drawings, taken together with the accompanying specification and claims.

DESCRIPTION OF THE PREFERRED EMBODIMENT

1. A First Embodiment

Figure 1:
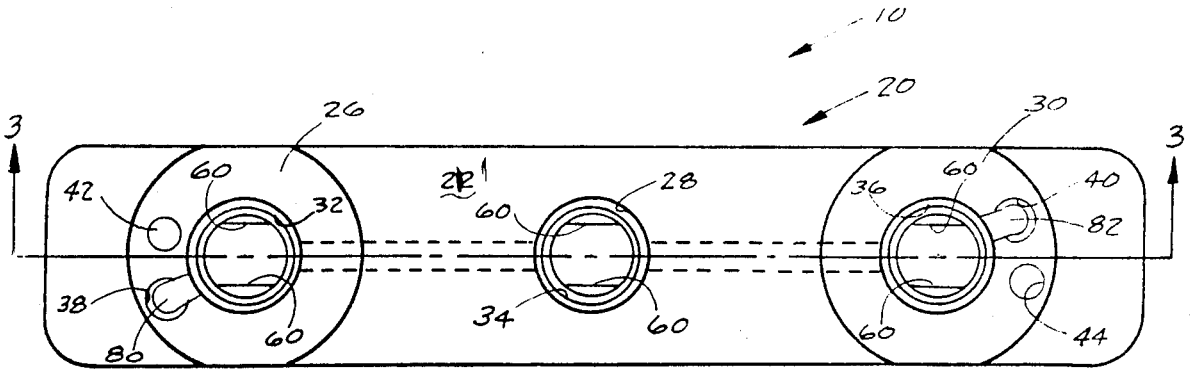
FIG. 1 is a plan view of a faucet manifold according to the invention.
Figure 2:
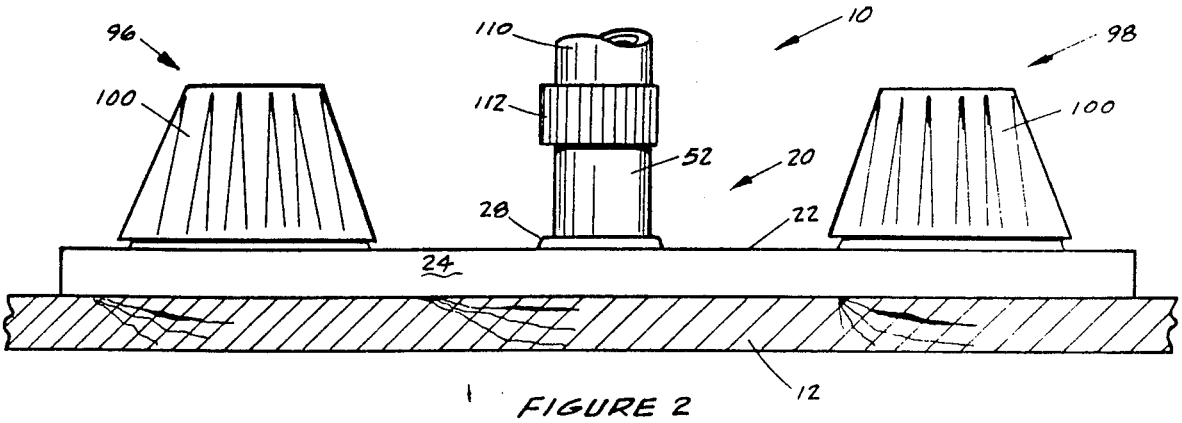
FIG. 2 is a side elevational view of the faucet manifold of FIG. 1.
Figure 3:
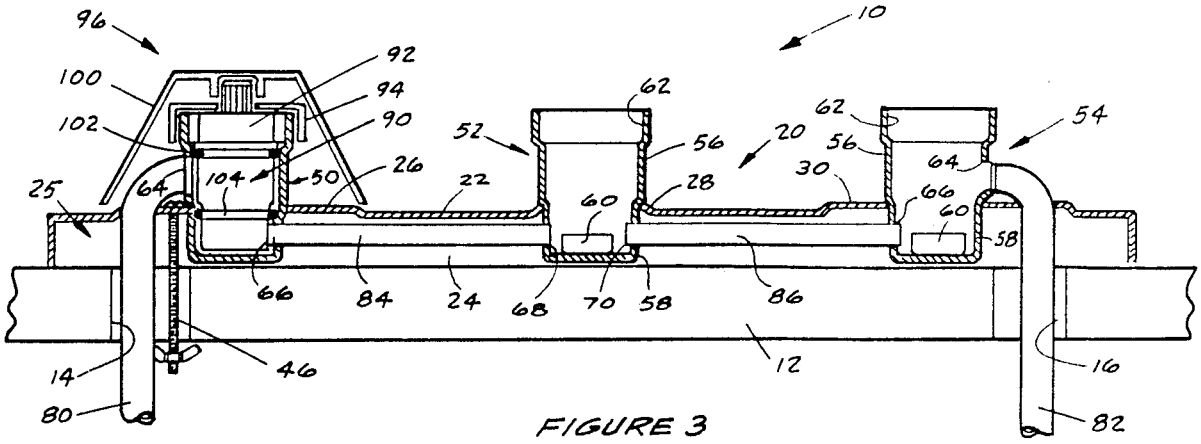
FIG. 3 is a cross-sectional view of the faucet manifold of FIG. 1 taken along a plane indicated by line 3—3 in FIG. 1, with certain components removed for purposes of clarity of illustration.

Referring to FIGS. 1-3, a first embodiment of a faucet manifold according to the invention is indicated generally by the reference numeral 10. The faucet manifold 10 is adapted to be placed atop a countertop 12 and to overlie openings 14, 16 formed in the countertop 12 through which access may be had to conventional water-conveying conduits (not shown). The manifold 10 includes a cover 20 defined by a generally rectangular, flat plate 22 having a downwardly extending skirt 24 at the periphery. The foregoing components create a chamber 25.

The plate 22 includes three raised areas 26, 28, 30 aligned along a longitudinal axis of the plate 22. Relatively large openings 32, 34, 36 are formed in the raised areas 26, 28, 30. Openings 38, 40 are formed in the raised areas 26, 30 adjacent the larger openings 32, 36. Smaller openings 42, 44 are located in the raised areas 26, 30 adjacent the openings 38, 40. Toggle bolts 46 (only one of which is shown in the Figures) extend through the openings 42, 44 and through the openings 14, 16 in the countertop 12.

Three sleeves 50, 52, 54 are disposed within the openings 32, 34, 36. The sleeves 50, 52, 54 are substantially identical and include a cylindrical body portion 56, a necked-down lower end 58 having indented sidewalls 60, and a threaded upper end 62. As can be seen in FIG. 3, the sleeves 50, 52, 54 can be inserted into the openings 32, 34, 36 only up to the intersection between the body portions 56 and the necked-down ends 58. Openings 64 are formed in the body portions 56 of the sleeves 50, 54 at a location above the upper surface of the plate 22. Openings 66 are formed in the necked-down ends 58 of the sleeves 50, 54 at a location within the chamber 25. Openings 68, 70 are formed in the necked-down end 58 of the sleeve 52 at a location 180° from each other.

Inlet tubes 80, 82 extend through the openings 14, 16, through the openings 38, 40, and into the openings 64 formed in the sleeves 50, 54. A connecting tube 84 extends between the openings 66, 68 included as part of the sleeves 50, 52. Another connecting tube 86 extends between the openings 66, 70 included as part of the sleeves 52, 54.

A cartridge-type valve member 90 is disposed within each of the sleeves 50, 54. The valve members 90 are similar in construction and operation to the cartridge-type valves disclosed and claimed in U.S. Pat. No. 4,557,288, issued Dec. 10, 1985, to Irlin H. Botnick. The valve members 90 will be described herein only to show how they interact with the various components of the faucet manifold 10.

The valve members 90 each include a drive member 92, a portion of which projects above the threaded upper ends 62. The valve members 90 are held in place within the sleeves 50, 54 by means of hold-down nuts 94. Cover knobs 96, 98 are secured to the upper ends of the drive members 92. The cover knobs 96, 98 include frusto-conical sidewalls 100 having a sufficiently largediameter base to completely surround, and thereby cover, the raised areas 26, 30. The valve members 90 also include O-rings 102, 104 which tightly engage the inner surface of the body portions 56 and the necked-down ends 58 of the sleeves 50, 54. The O-rings 102, 104 effect a watertight seal between the valve members 90 and the sleeves 50, 54.

A spout assembly 110 is secured to the threaded upper end 62 of the sleeve 52 by means of a hold-down nut 112. The spout assembly is similar to that disclosed in U.S. Pat. No. 4,557,288, issued Dec. 10, 1985, to Irlin H. Botnick, and further discussion here is unnecessary.

2. Assembly and Operation of the First Embodiment

A significant advantage of the present invention is that a great number of the components can be manufactured inexpensively, preferably in a stamping operation. The cover 20 is made of metal and can be formed in a single stamping operation. The sleeves 50, 52, 54 similarly are made of metal and can be formed in a stamping operation. The threaded upper ends 62 can be formed easily by conventional thread-rolling techniques.

The tubes 80, 82, 84, 86 are made of metal and are readily commercially available. Techniques for bending the tubes 80, 82 and for cutting the tubes 80, 82, 84, 86 to length are well known to those skilled in the art.

The faucet manifold 10 is assembled by placing braze rings about the necked-down ends 58 of the sleeves 50, 52, 54 and about the tubes 80, 82, 84, 86 at their juncture with the openings 64, 66, 68, 70. Thereafter, upon heating the manifold 10, the braze rings will melt and, upon cooling, will cause the manifold components to be assembled in a secure, watertight manner.

After the manifold 10 has been manufactured as described, the valve members 90 can be inserted into the sleeves 50, 54 and secured in place by the hold-down nuts 94. The flattened sidewall portions 60 cause the valve members 90 to be oriented properly relative to the sleeves 54. Similarly, the spout assembly 110 can be secured to the sleeve 52 by means of the hold-down nut 112.

In order to mount the faucet manifold 10 to the countertop 12, the toggle bolts 46 are fitted through the openings 42, 44. Thereafter, the manifold 10 is positioned atop the openings 14, 16 and the toggle bolts 46 are pushed downwardly through the openings 14, 16 to that position shown in FIG. 3. Upon tightening the toggle bolts 46, the cover 20 will be tightly pressed atop the countertop 12. If desired, a gasket (not shown) can be fitted between the lower edge of the skirt 24 and the countertop 12 in order to provide a watertight seal. Then, the tubes 80, 82 can be connected to the water-conveying conduits by any conventional technique. Upon securing the cover knobs 96, 98 to the drive members 92, installation of the faucet manifold 10 will be complete.

It will be appreciated from the foregoing description that the faucet manifold 10 includes a small number of components, but most importantly the need for any castings has been eliminated. The stamping operation for the sleeves 50, 54 is sufficiently accurate that a watertight connection between the sleeves 50, 54 and the valve members 90 can be carried out on a production basis. Because the cover 20 not only overlies the openings 14, 16, but also carries the sleeves 50, 52, 54, the cover 20 provides both a functional purpose as well as an esthetic purpose. The need for a separate decorative shell as in other faucet manifold constructions is eliminated.

3. Alternative Embodiments

Although the previously described embodiment of the invention avoids the difficulties and expense associated with casting operations, portions of the faucet manifold according to the invention can be formed in a casting operation, if desired. Different materials also can be substituted for materials employed in the previously described embodiment.

Referring to FIGS. 1–3, the cover 20 and the sleeves 50, 52, 54 can be formed as a unit in a die casting operation. In that circumstance, cores commonly employed to form internal cavities would not be necessary due to the configuration of the cover 20 and the sleeves 50, 52, 54. The openings 64, 66, 68, 70 can be formed by a machining operation, as can the threads 62. The water-conveying conduits 80, 82, 84, 86 can be connected to the sleeves 50, 52, 54 as in the previously described embodiment. Although the expense of the assembly just described is higher than that of the previously described embodiment, it still is less than that of a conventional faucet manifold employing a cast body portion.

If desired, the cover 20 and the sleeves 50, 52, 54 can be formed as a unit from a plastics material in an injection-molding operation. In that instance, the water-conveying conduits 80, 82, 84, 86 can be secured to the sleeves 50, 52, 54 by means of a cement or solvent. Further, in any of the embodiments described herein, the openings 64 can be formed at the bottom of the sleeves 50, 54 and the water-conveying conduits 80, 82 can be connected directly to the underside of the sleeves 50, 54. In order to provide such a connection, however, the valve members 90 must be modified to permit water to flow from the bottom of the sleeves 50, 54, upwardly through the sleeves 50, 54, and outwardly through the openings 66. Conventional washer-carrying valve stems engageable with valve seats surrounding the relocated openings 64 would be suitable for such a purpose. Such a modification of the valve members 90, as well as various techniques for manufacturing the components described herein and different materials suitable for manufacturing the components described herein, will be known to those skilled in the art.

4. The Preferred Embodiment

Figures 4, 5, 6:
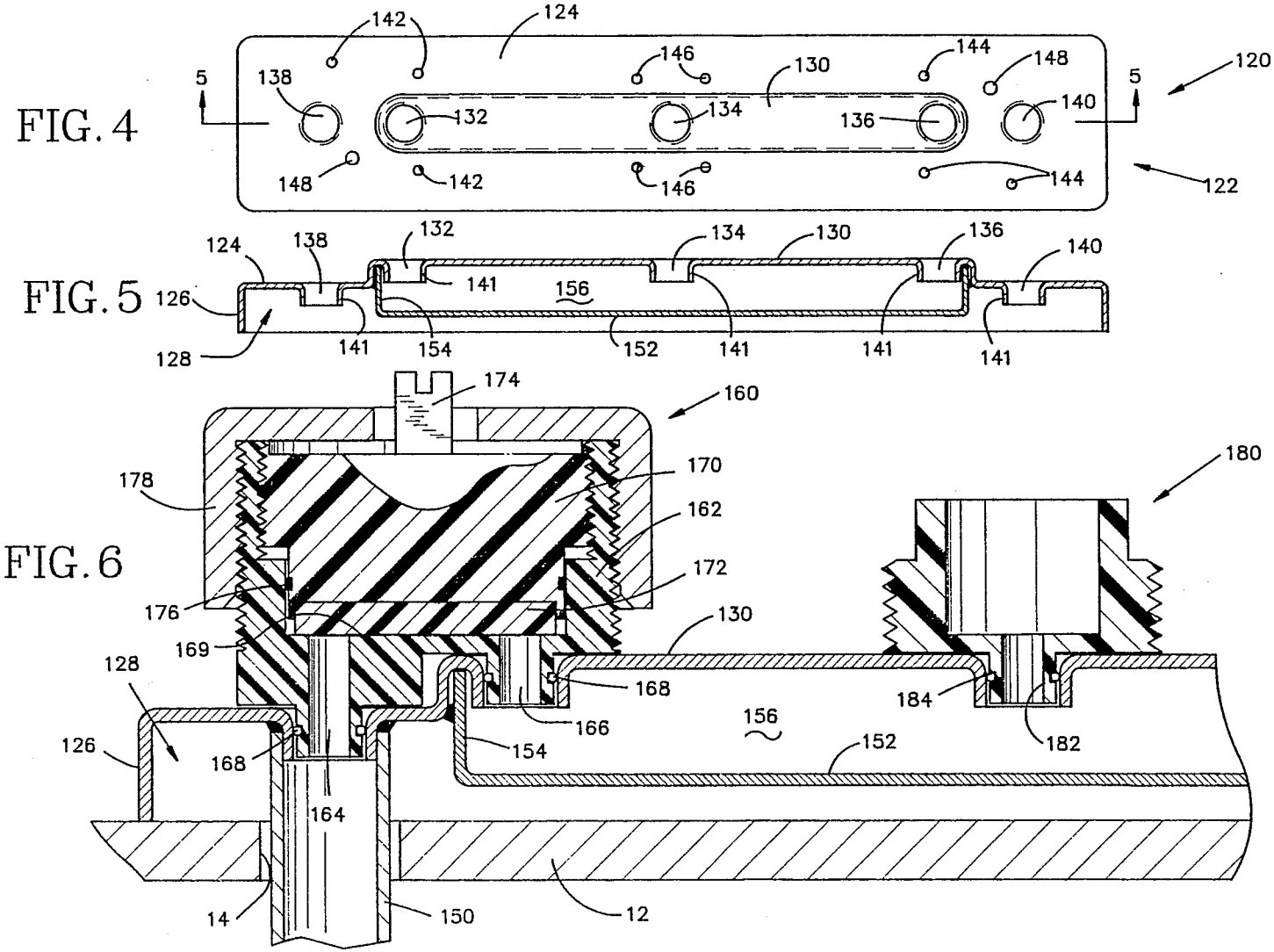
FIG. 4 is a plan view of a preferred embodiment of a faucet manifold according to the invention.
FIG. 5 is a cross-sectional view of the faucet manifold of FIG. 4 taken along a plane indicated by line 5—5 in FIG. 4.
FIG. 6 is an enlarged, cross-sectional view of a portion of the faucet manifold of FIG. 4, showing a valve cartridge and a spout adapter connected to the manifold.

Referring now to FIGS. 4–6, the preferred embodiment of a faucet manifold according to the invention is indicated generally by the reference numeral 120. The faucet manifold 120, like the faucet manifold 10, is adapted to be placed atop the countertop 12 and to overlie the openings 14, 16 formed in the countertop 12 through which access may be had to conventional water-conveying conduits. The manifold 120 includes a cover 122 defined by a generally rectangular plate 124 having a downwardly extending skirt 126 at the periphery. The foregoing components create a chamber 128.

The plate 124 includes an elongate, laterally extending, generally rectangular raised area 130 aligned along a longitudinal axis of the plate 124. Openings 132, 134, 136 are formed in the raised area 130, while openings 138, 140 are formed in the plate 124 at each end of the raised area 130. The openings 132, 134, 136, 138, 140 each include an annular flange 141 extending into the chamber 128. Three small openings 142 extend through the plate 124 in the region of the openings 132, 138, while three small openings 144 extend through the plate 124 in the region of the openings 136, 140. Four relatively small openings 146 extend through the plate 124 in the region of the opening 134. Larger openings 148 extend through the plate 124 adjacent the openings 138,

140. Toggle bolts (not shown) similar to the toggle bolts 46 referred to previously, extend through the openings 148 and through the openings 14, 16 in the countertop 12.

Inlet tubes 150 (only one of which is shown) extend through the openings 14, 16 and over the flanges 141 included as part of the openings 138, 140. A channel member 152, rectangular in plan view, is disposed within the chamber 128 and underlies the openings 132, 134, 136. The channel member 152 includes a peripheral skirt 154 which is fitted into the raised area 130, thereby defining a laterally extending flow passage 156.

A cartridge-type valve member 160 is fitted to the manifold 120 at each end of the cover 122. The valve member 160 represents one possible modification of the valve members 90 referred to earlier. It is expected that many of the components of the valve member 160 will be manufactured inexpensively in an injection molding operation using a plastics material such as CELCON. The valve member 160 should be sufficiently inexpensive that it can be replaced in its entirety in the event that one of its components malfunctions or wears out. Because the valve members 160 are identical, only the one shown in FIG. 6 will be described.

The valve member 160 includes a body portion 162 having first and second hollow projections 164, 166. The projection 164 extends into the opening 138, while the projection 166 extends into the opening 132. O-rings 168 are fitted about the projections 164, 166 in order to provide a fluidtight seal. The body portion 162 is hollow and includes a threaded interior surface as well as a flat bottom surface 169 through which the projections 164, 166 open. A threaded valve body 170 is disposed in the body portion 162. Upon rotating the valve body 170, its threads cooperate with the threads of the body portion 162 to cause the valve body 170 to be moved up or down within the body portion 162, depending on the direction of rotation of the valve body 170. The valve body 170 carries an elastomeric seal 172 at its bottom surface. The flat bottom surface 169 and the seal 172 cooperate to establish a fluidtight seal that can be opened or closed by the user (upon raising or lowering the valve body 170 by rotating it) so as to selectively permit or prevent the flow of water through the manifold 120.

An O-ring 176 is disposed about the valve body 170 in order to create a fluidtight seal between the valve body 170 and the interior of the body portion 162. A vertically extending stem 174, square in cross-section, projects upwardly from the valve body 170. A cover knob (not shown) is fitted to the stem 174 in order to enable the user to operate the valve member 160. An exterior portion of the body portion 162 is threaded, and a draw nut 178 is secured thereto. The draw nut 178 includes an opening at its center through which the stem 174 projects. The draw nut 178 constrains the valve body 170 such that the valve body 170 cannot be removed inadvertently from the body portion 162. Threaded fasteners (not shown) are fitted upwardly through the small openings 142, 144 and into threaded openings in the body portion 162 in order to hold the valve members 160 tightly in place against the plate 124.

A spout adapter 180 includes a projection 182. The projection 182 is fitted into the opening 134. An O-ring 184 is disposed about the projection 182 in order to create a fluidtight seal. Threaded fasteners (not shown) are fitted upwardly through the openings 146 and into threaded openings in the spout adapter 180 in order to hold the spout adapter 180 tightly in place against the plate 124. The outer surface of the spout adapter 180 is threaded in order to receive a hold down nut (not shown) which, in turn, holds a spout assembly securely in place.

5. Assembly and Operation of the Preferred Embodiment

As in the previously described embodiments of the present invention, a significant advantage of the preferred embodiment is that a great number of the components can be manufactured inexpensively, preferably in a stamping operation. The cover 122 is made of metal and can be formed in a single stamping operation. The channel member 152 similarly is made of metal and can be formed in a single stamping operation. It is to be understood that the term "stamping" refers to all techniques for stamping, including hydroforming.

The faucet manifold 120 is assembled by placing braze rings about the flanges of the openings 138, 140 at their intersection with the tubes 150, and about the periphery of the skirt 154 at its intersection with the raised area 130. Thereafter, upon heating the manifold 120, the braze rings will melt and, upon cooling, will cause the manifold components to be assembled in a secure, watertight manner.

After the manifold 120 has been manufactured as described, the valve members 160 can be mounted to the cover 122 by means of the threaded fasteners being run upwardly through the openings 142, 144 and into the body portion 162. Similarly, the spout adapter 180 can be secured to the cover 122 by means of threaded fasteners being run upwardly through the openings 146 and into the spout adapter 180. Mounting of the faucet manifold 120 to the countertop 12, and connection of the inlet tubes 150 to the water-conveying conduits proceeds as described previously for the faucet manifold 10.

Upon rotating the valve body 170 counterclockwise, the seal 172 will be backed away from the bottom surface 169. Water will flow upwardly through the projection 164, into the body portion 162, and downwardly through the projection 166. Thereafter, the water will flow laterally through the flow passage 156, and then out of the manifold 120 through the opening 134 and the spout adapter 180. Upon rotating the valve body 170 clockwise, the seal 172 eventually will engage the bottom surface 169 and the flow of water through the manifold 120 will be stopped.

As in the faucet manifold 10, the faucet manifold 120 includes a small number of components in which the need for any castings has been eliminated. Dimensional tolerances for the stamping operations are sufficiently accurate that watertight connections can easily be created wherever necessary. Because the cover 122 not only overlies the openings 14, 16, but also carries the valve members 160 and the spout adapter 180, as well as providing the flow passage 156, the cover 122 provides both a functional purpose as well as an aesthetic purpose. As with the faucet manifold 10, the need for a separate decorative shell is eliminated.

While such terms as "upper" and "downwardly" have been used to describe certain features of the invention, it will be understood that such terms are used for convenience only and that other terms could be selected to describe the relative relationship among the various components making up the invention. It also will be understood that although the invention has been described in its preferred form with a certain degree of particularity, the present disclosure of the preferred embodiment has been made only by way of example and numerous changes in the details of construction and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A method for making a faucet manifold, the faucet manifold being connectable to a water-conveying conduit, comprising the steps of:

stamping a plate having a skirt extending downwardly from the periphery of the plate;

stamping first, second, and third openings in the plate, the first, second, and third openings being spaced form each other, the first opening adapted to be connected to the water-conveying conduit, the second opening adapted to be selectively in fluid communication with the first opening, and the third opening adapted to be connected to an outlet;

stamping a channel member, the channel member being of a size and shape to underlie the second and third openings;

establishing a fluidtight seal between the cover and the channel member such that fluid flow between the second and third openings is possible;

providing a valve member for selectively controlling the flow of water from the first opening to the second opening;

connecting the valve member to the plate in contact with the first and second openings.

2. The method of claim 1, wherein the step of stamping a plate includes the step of creating a recessed area connecting the second and third openings.

3. The method of claim 1, wherein the channel member is trough-like and underlies the second and third openings.

4. The method of claim 1, wherein the step of establishing a fluidtight seal is carried out by brazing the channel member to the plate.

5. The method of claim 1, wherein the steps of stamping a plate and stamping first, second, and third openings in the plate are conducted at the same time.

6. A faucet manifold adapted to be mounted on a countertop over an opening through which access can be had to a water-conveying conduit, the manifold comprising:

a cover, the cover including a plate and a skirt extending downwardly from the periphery of the plate, the plate adapted to overlie the opening and the skirt adapted to engage the countertop, the plate being spaced from the surface of the countertop so as to define a chamber;

first, second, and third openings in the plate, the openings being spaced from each other, the first opening adapted to be connected to the water-conveying conduit, the second opening adapted to be selectively in fluid communication with the first opening, and the third opening adapted to be connected to an outlet;

a channel member, the channel member being of a size and shape to underlie the second and third openings; and a fluidtight seal between the cover and the channel member such that fluid flow between the second and third openings is possible; and a valve member connected to the plate, the valve member selectively controlling the flow of water from the first opening to the second opening.

7. The faucet manifold of claim 6, wherein the plate and channel member are formed of metal, and the plate and channel member are connected to each other by means of a brazed connection.

8. The faucet manifold of claim 6, wherein the channel member is trough-like.

9. The faucet manifold of claim 8, wherein the plate includes a recessed portion which, together with the channel member, defines a flow passage.

10. The faucet manifold of claim 6, wherein the valve member includes:

a body portion engaging the first and second openings to establish a fluidtight seal between the body portion and the openings;

a valve seat included as part of the body portion; and a valve element carried by the body portion, the valve element movable toward and away from the valve seat.

11. The faucet manifold of claim 10, wherein the fluidtight seal is created by O-rings disposed between the body portion and the openings.

12. The faucet manifold of claim 6, wherein the valve member is attached to the plate by means of threaded fasteners.

13. The faucet manifold of claim 6, further including a spout connected to the third opening for directing the flow of water outwardly of the third opening.

14. The faucet manifold of claim 6, further including:

an additional opening in the plate adjacent the first opening; and a toggle bolt extending through the additional opening, through the opening in the countertop, and into engagement with the underside of the countertop, whereby, upon tightening the toggle bolt from above the manifold, the cover will be clamped tightly to the countertop.

15. The faucet manifold of claim 6, wherein an additional opening is provided in the countertop through which access can be had to an additional water-conveying conduit, the additional opening being disposed beneath the plate, the assembly further including:

fourth and fifth openings in the plate spaced from the first, second, and third openings, the fourth opening adapted to be connected to the additional water-conveying conduit and the fifth opening adapted to be selectively in fluid communication with the fourth opening; and the channel member is of a size and shape to underlie the third and fifth openings and establish a fluidtight seal between the third and fifth openings.

16. The faucet manifold of claim 15, further including a second valve member connected to the plate, the second valve member selectively controlling the flow of water from the fourth opening to the fifth opening.

* * * * *